United States Patent [19]

May

[11] Patent Number: 5,025,697

[45] Date of Patent: Jun. 25, 1991

[54] MUSICAL DRUM REINFORCEMENT

[76] Inventor: Randall L. May, 7712 Unit B Talbert Ave., Huntington Beach, Calif. 92648

[21] Appl. No.: 594,013

[22] Filed: Oct. 9, 1990

[51] Int. Cl.[5] ..... G10D 13/02

[52] U.S. Cl. ..... 84/411 R; 84/413

[58] Field of Search ..... 84/411–420

[56] References Cited

U.S. PATENT DOCUMENTS 793,399 6/1905 Schultz ..... 84/413

4,295,405 10/1981 Sleishman ..... 84/413

4,928,565 5/1990 Hsieh ..... 84/411 R

*Primary Examiner*—Lawrence R. Franklin

*Attorney, Agent, or Firm*—Neal J. Mosely

[57] ABSTRACT

A musical drum is reinforced by a stiffening ring which is placed inside the shell of the drum at the edge adjacent to the drum head, and is adjusted by a screw to provide internal tension in the drum shell to prevent its being squeezed when the drum head is tightened. The stiffening ring additionally forms the open head, the bearing edge, of a wooden drum into a truer round, i.e. cylindrical, shape. This provides more accurate and precise tuning.

10 Claims, 2 Drawing Sheets

MUSICAL DRUM REINFORCEMENT

BACKGROUND OF THE INVENTION

1. Field of The Invention

This invention relates generally to a musical drum, and more particularly to an apparatus which reinforces and prevents deformation of the drum body when the drumhead is tightened excessively.

2. Brief Description of The Prior Art

There are several patents which disclose various accessories for musical drums which are in the nature of reinforcements. Pertinent prior art references include Somerville U.S. Pat. No. 2,564,933; Shier U.S. Pat. No. 4,289,056; Bonsor U.S. Pat. No. 4,869,146; and Hsieh U.S. Pat. No. 4,928,565.

Somerville U.S. Pat. No. 2,564,933 discloses an adjustable pressure ring for drums, which included several elements located inside the drum connected to external means for adjustment The disadvantage of such a device would be the distortion produced in the percussional tone. The present invention utilizes a single internal element, thus minimizing any effect on the percussional tone of the drum.

Shier U.S. Pat. No. 4,289,056 discloses a percussion kit comprising a collapsible drum, the drum having flexible side walls formed of a pair of generally parallel walls, the walls being adapted to be inflated to hold the drum in erected condition and deflated to allow the drum to collapse for transportation and storage. Such a device would have the obvious disadvantage of the wear and tear resulting from frequently inflating and deflating the flexible walls. The present invention utilizes a single internal element which is placed in one position, thus eliminating wear and tear due to moving or flexible parts.

Bonsor U.S. Pat. No. 4,869,146 discloses a musical drum having an outer cage to which both top and bottom counterhoops are connected in an independently adjustable manner. An intermediate hoop is provided between the top and bottom counterhoops to which a plurality of adjusting bolt assemblies for the top and bottom counterhoops are connected. Obviously, such a device has the disadvantage of requiring each and every bolt assembly to be adjusted independently, thereby requiring the drum to be "tuned" before playing. The present invention utilizes a single internal element requiring only one adjustment, if any, before playing begins.

Hsieh U.S. Pat. No. 4,928,565 discloses a musical drum with a pressure buffer element. The disadvantage of such a device is obvious in that the buffer element is integral to the drum and thereby located in a fixed position. The present invention utilizes an internal element the position of which can be adjusted as required to obtain the desired percussional tone of the drum.

With a standard drum, a particular percussional tone is derived by maintaining a certain tension in the drumhead. This tension is achieved when the drumhead is stretched over the upper brim of the drum body and clamped under a rim. Clamping screws pass through the rim and screw into threaded receptacles mounted on the side of the drum body. When the clamping screws are tightened, the rim clamps the drumhead down, stretching it across the drum body. However, if the drumhead is tightened excessively, the drum shell is squeezed inwardly and becomes slightly conical, thereby misaligning the bearing edge affecting the tension maintained across the drumhead and causing undesirable change in the percussional tone; when the drumhead is played, it produces unwanted and uncontrollable sound.

The present invention is distinguished over the prior art in general, and these patents in particular, by an apparatus which is disclosed for use in a musical drum that is a stiffening ring which is placed inside the shell of the drum at the edge adjacent to the drum head, and can be adjusted by a screw to provide internal tension in the drum shell to prevent its being squeezed inwardly when the drum head is tightened. The stiffening ring additionally forms the open head, the bearing edge, of a wooden drum into a truer round, i.e. cylindrical, shape. This provides more accurate and precise tuning.

SUMMARY OF THE INVENTION

It is therefore an object of the present invention to provide a new and improved reinforcement for a musical drum.

It is another object of this invention to provide a new and improved reinforcement for a musical drum wherein the drumhead is prevented from exerting an excess of pressure on the drum body.

Another object of this invention is to provide a new and improved reinforcement for a musical drum that is an adjustable stiffening ring which is placed inside the drum shell at the edge adjacent to the drum head.

Another object of this invention is to provide a new and improved reinforcement for a musical drum that will apply pretension to the drum shell and prevent its being squeezed inwardly when the drum head is tightened.

Still another object of this invention is to provide a new and improved reinforcement for a musical drum that is a stiffening ring which is placed inside the drum shell at the edge adjacent to the drum head and may be adjusted by a screw.

Still another object of this invention is to provide a new and improved reinforcement for a musical drum that maintains tension in the drumhead necessary to produce the desired percussional tone of the drum.

Other objects of the invention will become apparent from time to time throughout the specification and claims as hereinafter related.

The above noted objects and other objects of the invention are accomplished by an apparatus which is disclosed for use in a musical drum that is a stiffening ring which is placed inside the shell of the drum at the edge adjacent to the drum head, and can be adjusted by a screw to provide internal tension in the drum shell to prevent its being squeezed inwardly when the drum head is tightened. With a standard drum, a particular percussional tone is derived by maintaining a certain tension in the drumhead. The stiffening ring additionally forms the open head, the bearing edge, of a wooden drum into a truer round, i.e. cylindrical, shape. This provides more accurate and precise tuning.

DESCRIPTION OF THE PREFERRED EMBODIMENT

Figure 1:
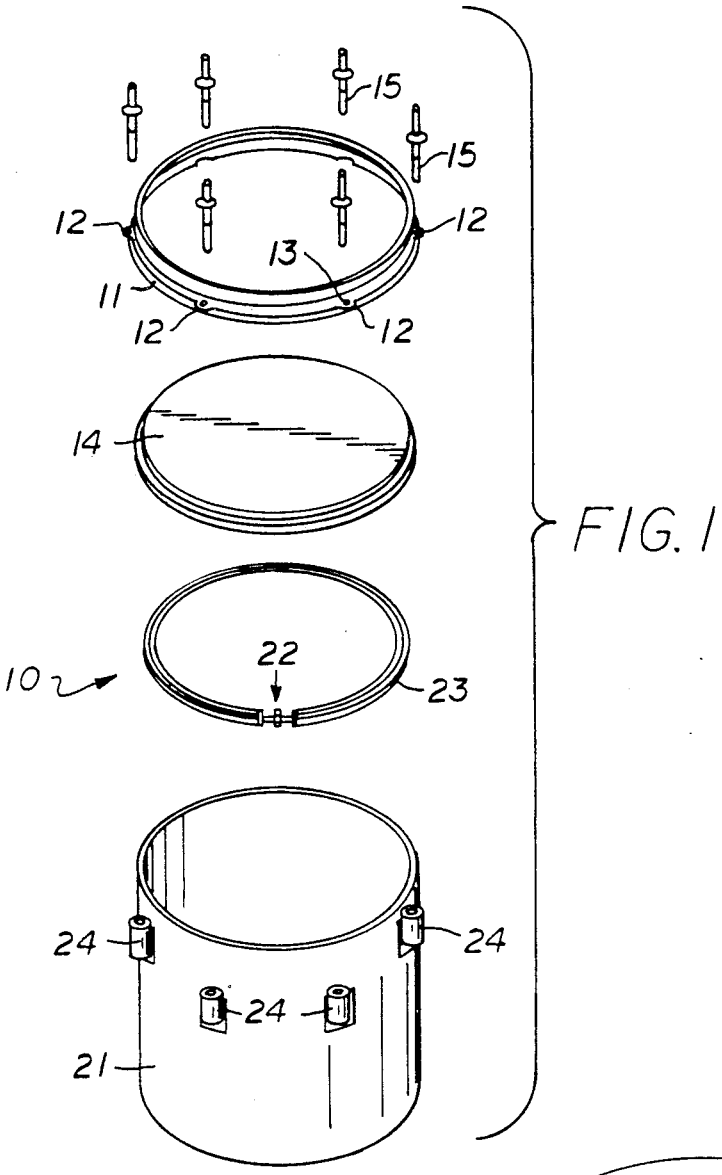
FIG. 1 is an exploded isometric view of a reinforced musical drum in accordance with the present invention.

Referring to the drawings by numerals of reference, and more particularly to FIG. 1, there is shown a preferred embodiment of a reinforced musical drum 10 in accordance with the present invention. The drum 10 has a rim 11 with a plurality of tabs 12 equally spaced around its outer edge. Each tab 12 has a hole 13 through which a respective clamping and adjusting screw 15 passes. The clamping screws 15 are screwed into threaded receptacles 24 in order to pull the rim 11 downward clamping the drumhead 14 to the drum body 21. The tightening of the clamping screws 15 tightens the drumhead 14 but causes it to exert a pressure inwardly around the top of the wooden drum shell 21.

Figure 2:
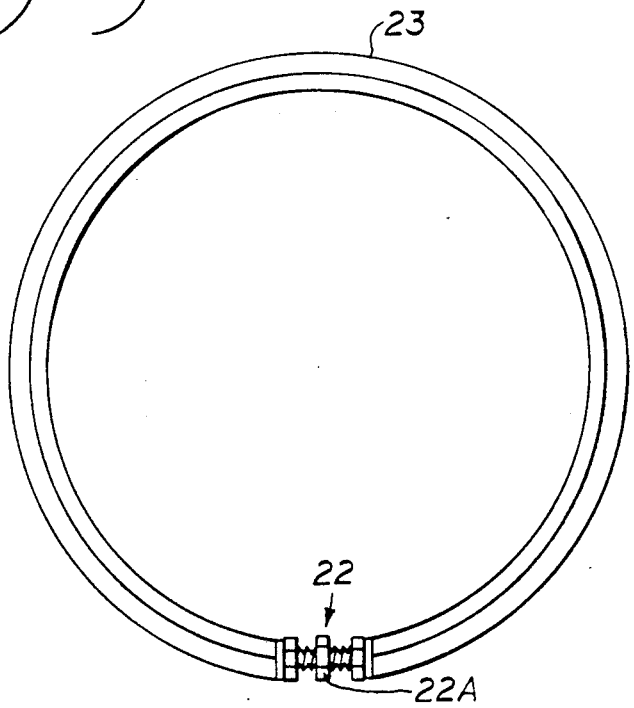
FIG. 2 is a detail plan view of the stiffening ring for reinforcing a musical drum in accordance with the present invention.
Figure 5:
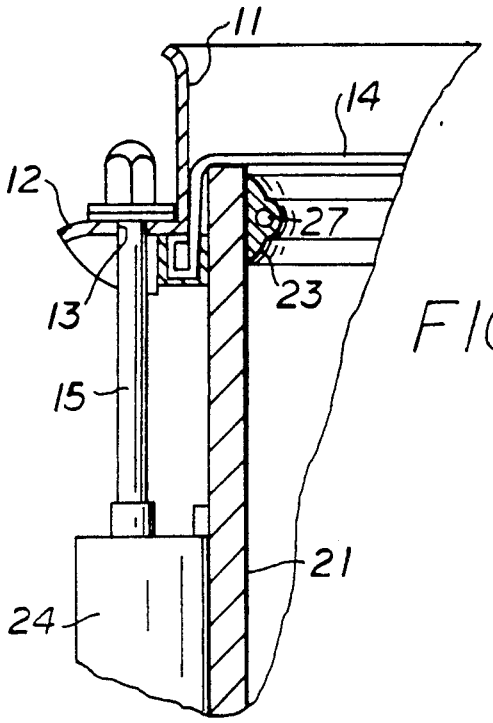
FIG. 5 is a sectional view of a drumhead reinforcement assembly installed in accordance with the present invention.
Figure 3:
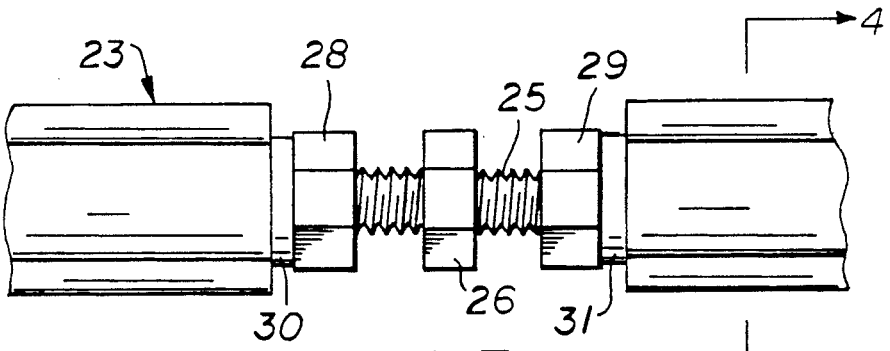
FIG. 3 is a detail view of the adjustment means for the stiffening ring of FIG. 2.
Figure 4:
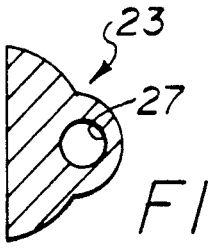
FIG. 4 is a sectional view taken on the line 4—4 of FIG. 3.

As shown in detail in FIGS. 2–4, the drum is reinforced by a stiffening ring 23 which is placed inside the wooden drum shell 21 of the drum at the edge adjacent to the drum head 14. Stiffening ring 23 has a turnbuckle type of adjustment comprising a threaded shaft 25 having a hexagonal bolt head 26 integral therewith for turning the turnbuckle. The opposite ends of shaft 25 are threaded in opposite directions and fit into a cylindrical recess 27 in stiffening ring 23. Nuts 28 and 29 are threaded on the ends of shaft 25. Washers 30 and 31 are positioned between the nuts 28 and 29 and the ends of stiffening ring 23. Turning bolt head 26 in one direction moves the nuts 28 and 29 toward the center of the shaft 25 while turning in the other direction moves them, toward the ends of the shaft. Internal tension is applied to the inside wall of the drum shell 21 by stiffening ring 23 along the edge where the drumhead fits. The tension can be adjusted by turning the bolt head 26 to extend or retract the nuts 28 and 29 on shaft 25.

OPERATION

While the operation of this invention should be obvious from the description of the preferred embodiment, it will be stated herein for clarity.

The stiffening ring 23 is placed inside the wooden shell 21 of the drum at the edge adjacent to the drum head 14. By selectively turning the bolt head 26, nuts 28 and 29 turn on shaft 26, bearing against washers 30 and 31 to extend or retract the stiffening ring 23 in contact with the inside wall of the drum shell 21 until the desired internal tension is applied to the inside wall of the drum shell 21 to prevent the drum shell from being compressed inward when the drum head 14 is installed and tightened. If desired, the stiffening ring 23 may have an end flange covering the edge of the drum shell or rebent to form a channel enclosing the edge of the drum shell.

While this invention has been shown fully and completely with special emphasis on a preferred embodiment, it should be understood that, within the scope of the appended claims, the invention may be practiced otherwise than as specifically described herein.

I claim:

1. The combination with a musical drum comprising a drum shell, a drum head fitted on an open end of said drum shell, a rim, and adjusting screws for tightening said drum head on said drum shell, of a stiffening ring removably positioned inside said drum shell against the wall thereof at the edge adjacent to the drum head, and means for adjusting said stiffening ring to apply predetermined tension against said drum shell to prevent inward compression of said drum shell when said drum head is tightened thereon.

2. The combination according to claim 1 in which said stiffening ring is metal.

3. The combination according to claim 1 in which: said stiffening ring has a cylindrical outer surface fitting the wall of said drum shell.

4. The combination according to claim 1 in which said stiffening ring is metal, and said stiffening ring has a cylindrical outer surface fitting the wall of said drum shell.

5. The combination according to claim 1 in which said means for adjusting said stiffening ring comprises a turnbuckle assembly.

6. The combination according to claim 1 in which said stiffening ring comprises a metal ring split at one point with a turnbuckle assembly secured therein for adjusting the circumference of the ring.

7. The combination according to claim 1 in which said stiffening ring comprises a metal ring split at one point and having cylindrical recesses in the split ends thereof, and said adjusting means fitting in said cylindrical recesses of the ring.

8. The combination according to claim 1 in which said stiffening ring comprises a metal ring split at one point and having cylindrical recesses in the split ends thereof, and said adjusting means comprising a threaded shaft fitted in said cylindrical recesses of the ring and adjustable to vary the circumference of said ring.

9. The combination according to claim 1 in which said stiffening ring comprises a metal ring split at one point and having cylindrical recesses in the split ends thereof, and said adjusting means comprising a threaded shaft fitted in said cylindrical recesses of the ring, nuts threaded on said shaft and operatively engaging the split ends of said ring, whereby relative rotation of said shaft and nuts adjusts the position of said nuts thereon to vary the circumference of said ring.

10. The combination according to claim 1 in which said stiffening ring comprises a metal ring split at one point and having cylindrical recesses in the split ends thereof, and said adjusting means comprising a threaded shaft fitted in said cylindrical recesses of the ring, nuts threaded on said shaft, washers positioned on said shaft and engaging said nuts and the split ends of said ring, whereby relative rotation of said shaft and nuts adjusts the position of said nuts thereon to vary the circumference of said ring.

* * * * *